United States Patent [19]

Sato et al.

[11] Patent Number: 4,895,202

[45] Date of Patent: Jan. 23, 1990

[54] ENDLESS TRACK TYPE CONTINUOUS CASTING MACHINE

[75] Inventors: Hisashi Sato; Shuzo Takahashi; Shiro Osada, all of Yokohama; Yutaka Tsuchida, Yokusuka; Nobuhisa Hasebe, Yokohama, all of Japan

[73] Assignees: Ishikawajima-Harima Jukogyo Kabushiki Kaisha; Nippon Kokan Kabushiki Kaisha, both of Japan

[21] Appl. No.: 271,936

[22] Filed: Nov. 15, 1988

[30] Foreign Application Priority Data

Feb. 12, 1988 [JP] Japan ..... 63-30115

[51] Int. Cl.[4] ..... B22D 11/06

[52] U.S. Cl. ..... 164/430; 164/481

[58] Field of Search ..... 164/430, 431, 432, 436, 164/481, 491

[56] References Cited

U.S. PATENT DOCUMENTS

| | | | |
|---|---|---|---|
| 3,570,586 | 7/1967 | Lauener | 164/430 |
| 3,645,321 | 2/1972 | Robinson | 164/430 |

FOREIGN PATENT DOCUMENTS

| | | | |
|---|---|---|---|
| 49-47131 | 12/1974 | Japan . | |
| 59-147749 | 8/1984 | Japan . | |
| 62-227557 | 8/1987 | Japan | 164/431 |

*Primary Examiner*—Richard K. Seidel
*Assistant Examiner*—Rex E. Pelto

[57] ABSTRACT

In a mold cavity and/or in horizontal cooling zones, upstream- and downstream-side gears are drivingly coupled to each other through an endless-track-like member to which the tensile force is exerted by a tensioner, so that gaps between the adjacent block molds can be eliminated and therefore intrusion and leakage of a cooling liquid and melt are prevented.

5 Claims, 6 Drawing Sheets

ENDLESS TRACK TYPE CONTINUOUS CASTING MACHINE

BACKGROUND OF THE INVENTION

The present invention relates to an endless track type continuous casting machine capable of preventing intrusion and leakage of a cooling liquid through interfaces between adjacent block molds.

Referring first to FIG. 1, a conventional endless track type continuous casting machine will be described. A plurality of block molds 1 are interconnected in the form of an endless track to define a mold assembly 2. A pair of such mold assemblies 2 are disposed in vertically opposing relationship to define a mold cavity 3. A tundish nozzle 5 extends from a bottom of a tundish 4 into an upstream opening of the mold cavity 3. Reference numeral 6 denotes driving rolls; 7, idle rolls; and 8, a casting.

According to the continuous casting machine with the above-described construction, melt is poured into the tundish 4 and is supplied through the tundish nozzle 5 into the mold cavity 3 defined between the upper and lower mold assemblies 2 which are moved in the same direction by the driving and idle rolls 6 and 7. Melt is cooled by the block molds 1 to solidify into a casting 8 which is discharged out of the continuous casting machine.

With the continuous casting machine of the type described above, a cooling zone of each mold assembly 2 is limited to the return path of the mold assembly 2 which is relatively short in length so that the block molds 1 are not sufficiently cooled when they return to the upstream opening of the mold cavity 3, resulting in a fear of failure in continuous casting operation.

In view of the above, the inventors have recently proposed a continuous casting machine as shown in FIGS. 2–5 having sufficiently long cooling zones.

More specifically, a pair of upper and lower mold assemblies 2 each comprising a plurality of block molds 1 interconnected in the form of an endless track are disposed in vertically opposing relationship to define the mold cavity 3. Inclined and horizontal cooling zones 9 and 10 which are relatively long in length are defined between downstream and upstream openings of the mold cavity 3 for each of the mold assemblies 2 as shown in FIG. 2. Each mold assembly 2 is driven by gears 12 and 12′ drivingly coupled to a mold-assembly driving system comprising an electric motor 22, a reduction gear 25 and universal spindles 41 (See FIG. 3) and is braked at the downstream portion of the mold cavity 3 through a gear 13. Such braking of the mold assembly 2 contributes to preventing melt from leaking through gaps between the block molds 1 produced in the mold assembly moving in the path defining the mold cavity 3. Reference numeral 11 represents a driven gear.

As shown in FIGS. 3–5, each block mold 1 is securely joined to a carrier 14 which has at its either side racks 15 in mesh with the gears 12 and 13 and furthermore has at its either side two wheels 16 for engagement with the gear 12′ as shown in FIG. 5.

One of the two wheels 16 is directly supported by the carrier 14 through a shaft 17 while the other wheel 16 is indirectly supported through a shaft 17 by a bearing box 19 fitted into a groove 18 defined in the carrier 14 such that the directly supported wheel 16 on an adjacent carrier 14 is driven in the direction of the movement of the block molds 1.

More specifically, the shaft 17 which is directly supported by the carrier 14 is mounted with a bearing box 19 which is the same in construction with the bearing box 19 described above and which is slidably fitted into a groove 18 of a backward or forward adjacent carrier 14. Moreover, the shaft 17 which is directly supported by the latter carrier 14 is slidably carried through a bearing box 19 by its backward or forward adjacent carrier 14. Thus the carriers 14 are sequentially interconneted so that the block molds 1 are interconnected in the form of an endless track as described above. Each frame 20 is formed with an endless-track-like groove 21 into which the wheels 16 are rotatably fitted.

In FIGS. 3 and 4, reference numeral 23 represents a brake; 24, a side dam block interposed between the upper and lower opposing block molds 1 and adapted to move in synchronism with the block molds 1; 42, shafts of the gears 12 and 12′; and 43, bearings.

In operation, the motor 22 is energized to drive the block molds 1 through the gears 12 and the racks 15 while the side dam blocks 24 are also driven in synchronism with their corresponding block molds 1. Furthermore, the brakes 23 are energized to brake the mold assemblies 2 through the gears 13 and the racks 15 such that no gap is produced between the adjacent block molds 1 which define the mold cavity 3. In this case, the wheels 16 roll in the grooves 21 so that the mold assemblies 2 are smoothly driven.

Melt in the tundish 4 is supplied through the tundish nozzle 5 into the mold cavity 3 and is cooled by the block molds 1 to solidify into the casting 8 which in turn is discharged out of the continuous casting machine. The mold assemblies 2 are cooled by any means in the cooling zones 9 and 10 and the cooled block molds 1 of the mold assemblies 2 return to the upstream opening of the mold cavity 3.

As described above, the continuous casting machine shown in FIGS. 2–5 has the cooling zones 9 and 10 which are relatively long in length so that the block molds 1 are satisfactorily cooled until they return to the upstream opening of the mold cavity 3 and consequently the continuous casting operation is not adversely affected.

With the conventional endless track type continuous casting machines of the types described above, the return path or cooling zone shown in FIG. 1 and the horizontal cooling zone 10 shown in FIG. 2 have no means to eliminate gaps between the adjacent block molds 1 which are passing such cooling zones, so that a large quantity of cooling liquid leaks through the gaps between the adjacent block molds 1 in the cooling zone and the leaked cooling liquid cannot be completely recovered. In addition, the leaked cooling liquid enters the continuous casting machine, causing various adverse effects.

Meanwhile, as to the mold cavity 3, the brakes 23 are provided as means for eliminating the gaps between the adjacent block molds 1 so as to prevent melt from leaking out of the mold cavity 3. Because of the brakes 23, the motor 22 must produce driving force which can overcome the braking forces of the brakes 23 so that a large quantity of energy is consumed.

In view of the above, a primary object of the present invention is to provide an endless track type continuous casting machine which can eliminate the gaps between the adjacent block molds passing through the mold cavity as well as horizontal cooling zones without use of brakes so that a cooling liquid and melt are prevented from leaking through interfaces between the adjacent block molds and the consumption of the driving energy is reduced to a minimum.

The above and other objects, effects, features and advantages of the present invention will become more apparent from the following description of a preferred embodiment thereof taken in conjunction with the accompanying drawings.

BRIEF DESCRIPTION OF THE DRAWINGS

The same reference numerals are used to designate similar part throughout the figures.

DETAILED DESCRIPTION OF THE PREFERRED EMBODIMENT

Figure 1:
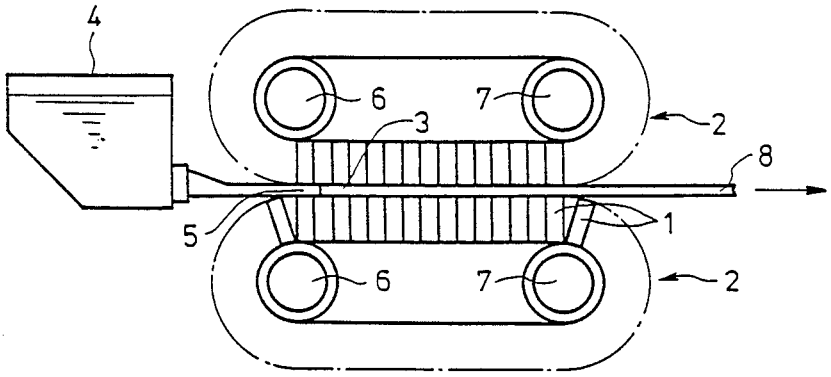
Fig. 1 PRIOR ART
FIG. 1 is a schematic view used to explain a conventional endless track type continuous casting machine.
Figure 2:
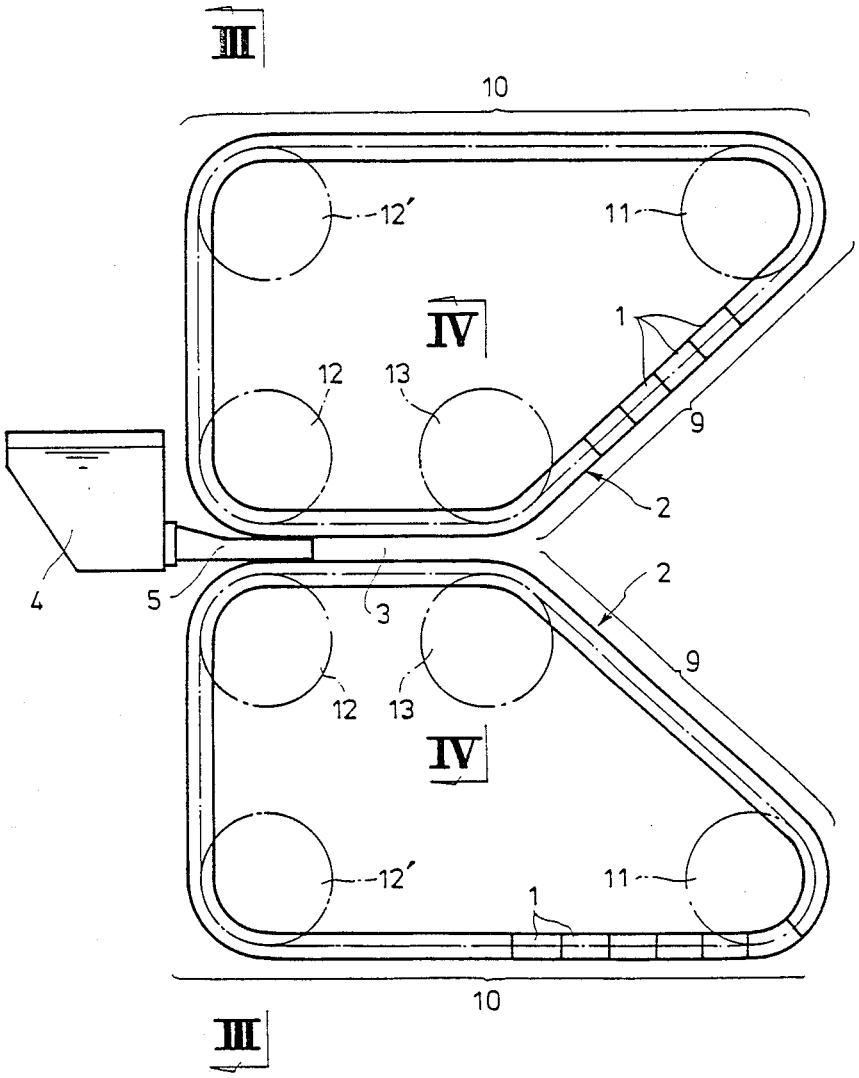
Fig. 2 PRIOR ART
FIG. 2 is a schematic view used to explain another conventional endless track type continuous casting machine.
Figure 3:
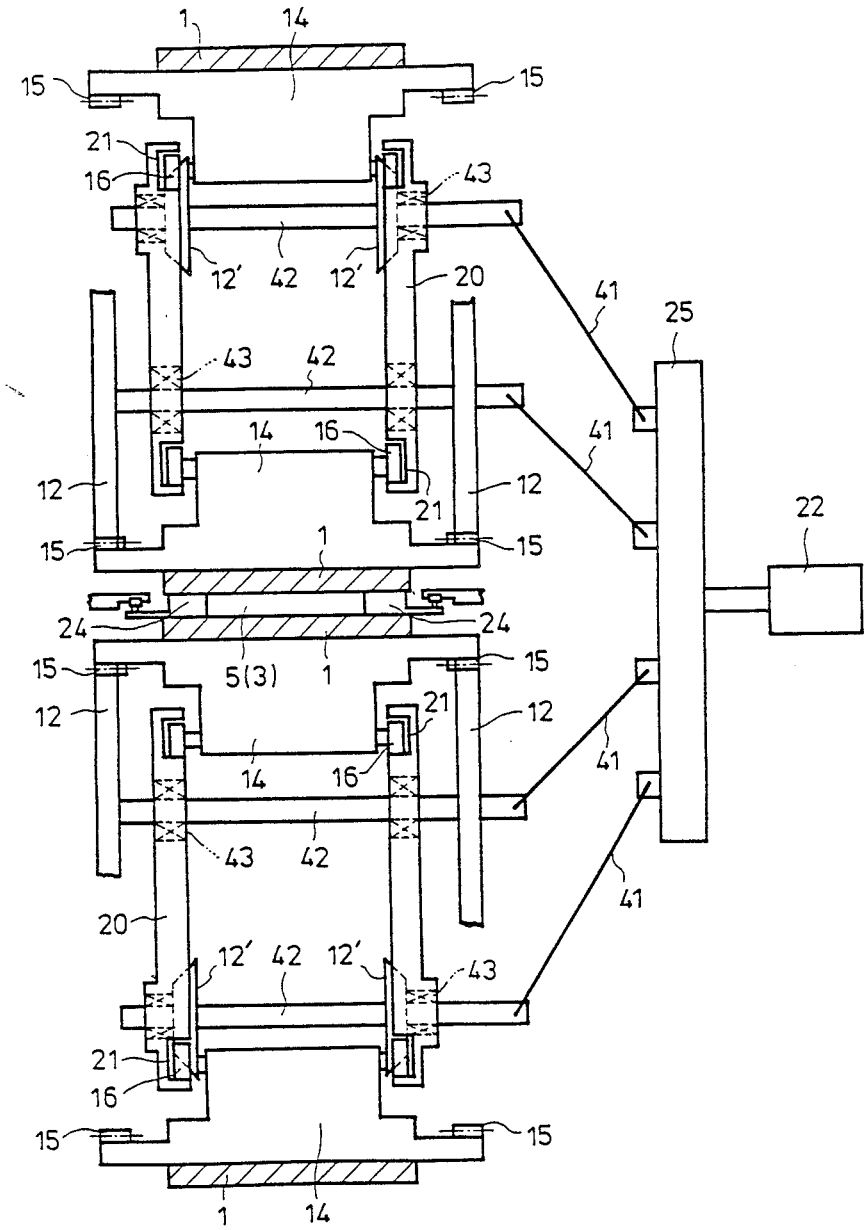
Fig. 3 PRIOR ART
FIG. 3 is a sectional view taken along the line III—III in FIG. 2.
Figure 4:
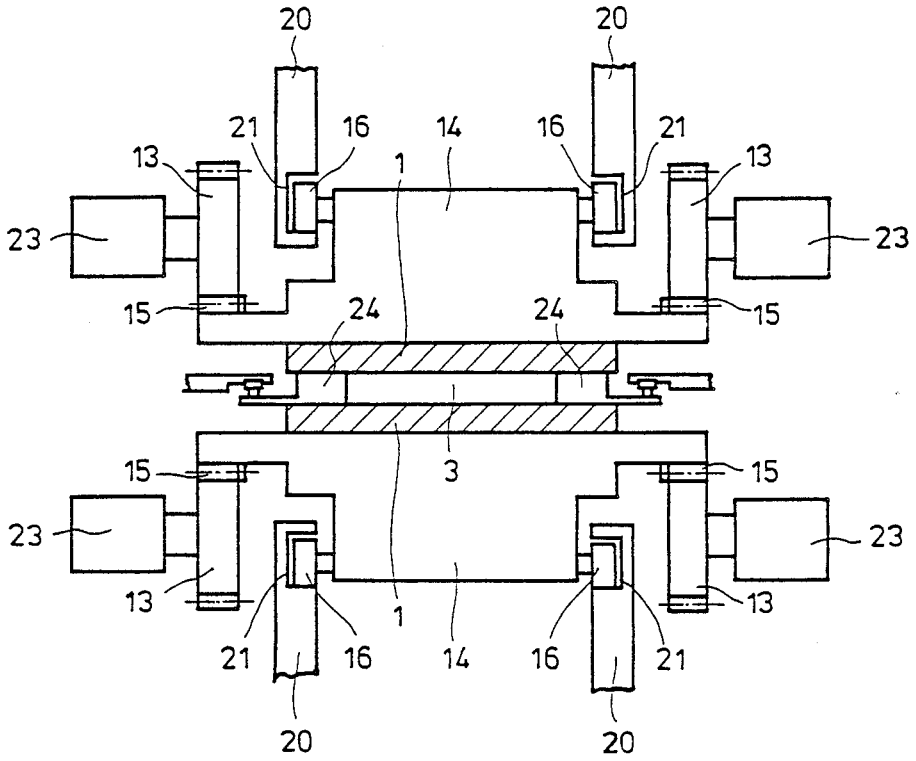
Fig. 4 PRIOR ART
FIG. 4 is a sectional view taken along the line IV—IV in FIG. 2.
Figure 5:
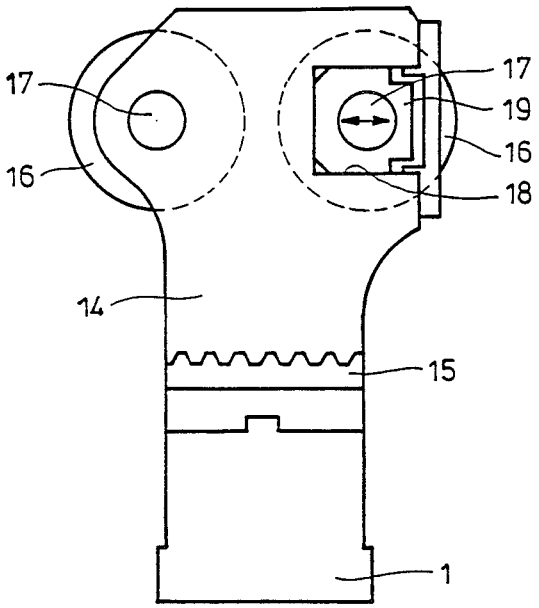
Fig. 5 PRIOR ART
FIG. 5 is a view used to explain the block mold and its carrier.
Figure 6:
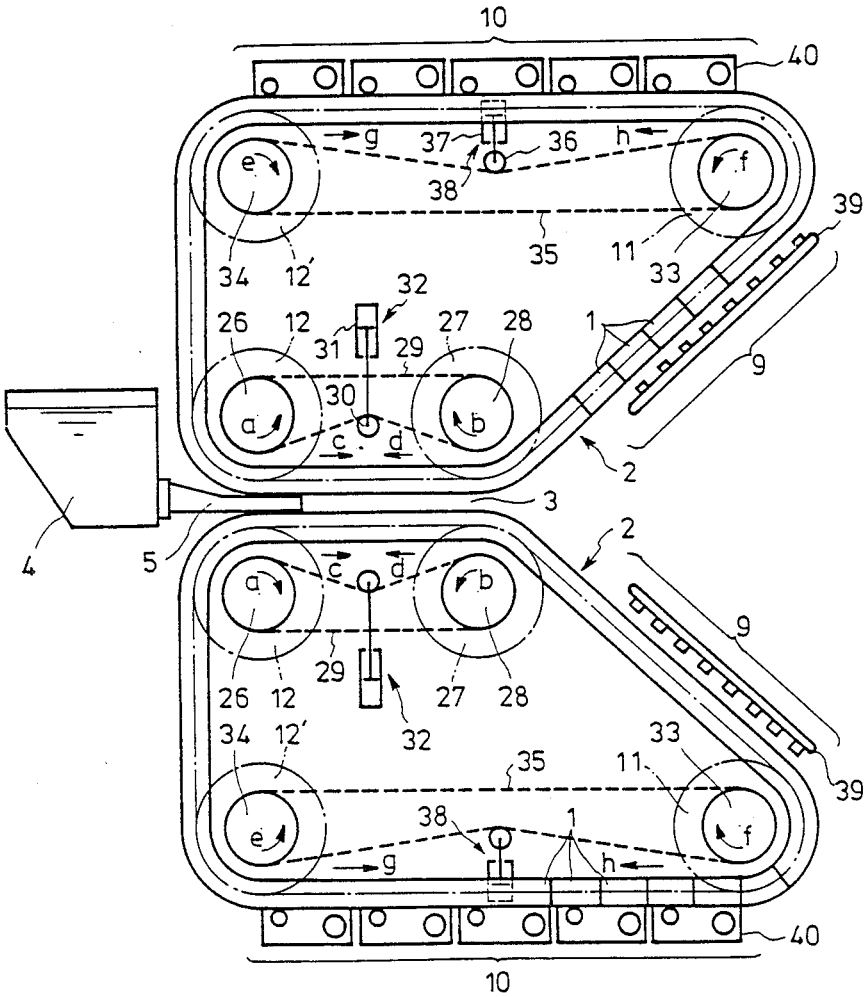
FIG. 6 is a view used to explain a preferred embodiment of the present invention.

Referring now to FIG. 6, a preferred embodiment of the present invention will be described. A sprocket 26 is carried by the shaft of the upstream side gear 12 for the mold cavity 3 coaxially thereof while a sprocket 28 is carried by the shaft of the downstream side driven gear 27 for the mold cavity 3 coaxially thereof, the sprockets 26 and 28 being drivingly interconnected through an endless chain 29. Further provides is a tensioner 32 comprising a sprocket 30 in engagement with the endless chain 29 on the side of the mold assembly 2 as well as a vertical cylinder 31.

In like manner, in the horizontal cooling zone 10, a sprocket 33 is carried by the shaft of the upstream side driven gear 11 coaxially thereof while a sprocket 34 is carried by the shaft of the downstream side driving gear 12' coaxially thereof, the sprockets 33 and 34 being drivingly interconnected by an endless chain 35. Also provided is a tensioner 38 comprising a sprocket 36 in engagement with the endless chain 35 on the side of the mold assembly 2 as well as a vertical cylinder 37.

Reference numeral 39 represents a mist coolant device disposed in the inclined cooling zone 9; and 40, a coolant chamber disposed in the horizontal cooling zone 10.

The continuous casting operation is carried out in a manner substantially similar to that described above with reference to FIGS. 2–5 and concurrently, according to the present invention, the piston of the cylinder 31 of the tensioner 32 is retracted to exert the tension to the endless chain 29 on the side of the mold assembly 2 so that the forces are exerted to the sprockets 26 and 28 in the directions indicated by the arrows a and b, respectively. As a result, the forces are exerted to the block molds 1 defining the mold cavity 3 in the directions indicated by the arrows c and d, respectively, so that the leakage of melt and the intrusion of a cooling liquid through the interfaces between the adjacent block molds 1 can be prevented because of no gaps between the block molds 1.

In like manner, in the horizontal cooling zone 10, the piston of the cylinder 37 of the tensioner 38 is extended to exert tension to the endless chain 35 passing on the side of the mold assembly 2 so that the forces are exerted to the sprockets 34 and 33 in the directions indicated by the arrows e and f, respectively. As a result, the forces are exerted to the block molds 1 passing through the horizontal cooling zone 10, in the directions indicated by the arrows g and h, respectively, so that any gaps between the adjacent block molds 1 are eliminated and consequently leakage of a cooling liquid through the interfaces between the adjacent block molds 1 is prevented.

As described above, according to the present invention, tensile forces are utilized to eliminate the gaps between the adjacent block molds 1 so that a high degree of driving power is not needed and therefore the energy consumption during the driving of the upper and lower mold assemblies 2 can be reduced to a minimum.

It is to be understood that the present invention is not limited to the preferred embodiment just described above and that various modifications may be effected within the true spirit and scope of the present invention. For instance, any suitable device capable of accomplishing the functions of the endless-track-like members and the tensioners may be used.

As described above, with the endless track type continuous casting machine in accordance with the present invention, the upstream- and downstream-side gears in the mold cavity and/or in the horizontal cooling zone are drivingly interconnected by endles-track-like member means and the tensioner means is operatively connected to the endless-track-like member means passing on the side of the mold assesmbly so that the gaps between the adjacent block molds are eliminated. As a result, the intrusion and leakage of a cooling liquid and melt can be prevented and as compared with the case where brakes are utilized to eliminate the gaps between the adjacent block molds, the energy for driving the mold assemblies can be considerably reduced.

What is claimed is:

1. In an endless track type continuous casting machine having a pair of upper and lower endless-track-like mold assemblies each comprising a plurality of block molds interconnected and made to pass around gears, said mold assemblies being disposed such that opposing surfaces of said mold assemblies are driven in a same direction to thereby define a mold cavity, and horizontal cooling zones downstream of said mold cavity, an improvement comprising endless-track-like member means through which upstream- and downstream side gears for at least one of said mold cavity and said horizontal cooling zones are drivingly interconnected, and tensioner means operatively coupled to said member means passing on a side of the corresponding mold assembly.

2. The machine according to claim 1 wherein said member means comprises an endless chain which passes over sprockets mounted on shafts of said gears coaxially thereof.

3. The machine according to claim 2 wherein said tensioner means comprises a sprocket in engagement with said endless chain and a cylinder for vertically displacing said sprocket.

4. The machine according to claim 3 wherein said cylinder is interposed between the corresponding mold assembly and said endless chain.

5. The machine according to claim 3 wherein said cylinder is disposed on opposite side of the corresponding mold assembly with respect to said endless chain.

* * * * *